US007704118B2

(12) United States Patent
Divnick

(10) Patent No.: US 7,704,118 B2
(45) Date of Patent: Apr. 27, 2010

(54) DEVICE FOR COLLECTING AND PLAYING WITH CIRCULAR AND SPHERICAL OBJECTS WITH LAUNCHING RAMPS THEREON

(76) Inventor: Stevan M. Divnick, 321 Alexandersville Rd., Miamisburg, OH (US) 45342

( * ) Notice: Subject to any disclaimer, the term of this patent is extended or adjusted under 35 U.S.C. 154(b) by 510 days.

(21) Appl. No.: 11/693,043

(22) Filed: Mar. 29, 2007

(65) Prior Publication Data

US 2008/0242184 A1 Oct. 2, 2008

(51) Int. Cl.
*A45C 1/12* (2006.01)
*A45C 1/00* (2006.01)

(52) U.S. Cl. ..... 446/8; 453/18; 194/344

(58) Field of Classification Search ..... 446/8, 446/11; 453/18, 39; 194/344, 350, 352
See application file for complete search history.

(56) References Cited

U.S. PATENT DOCUMENTS

| | | | | |
|---|---|---|---|---|
| 433,736 | A | | 8/1890 | Lockwood |
| 3,092,928 | A | | 6/1963 | Geiser |
| 3,638,350 | A | * | 2/1972 | Wiggen ..... 446/168 |
| 3,738,658 | A | * | 6/1973 | Smith ..... 273/109 |
| 4,297,807 | A | * | 11/1981 | Buettner ..... 446/11 |
| 4,475,564 | A | * | 10/1984 | Koester et al. ..... 453/57 |
| D289,218 | S | | 4/1987 | Divnick |
| 4,762,512 | A | | 8/1988 | Divnick |
| 4,871,055 | A | | 10/1989 | Poythress |
| 4,903,825 | A | | 2/1990 | Harlan |
| D307,503 | S | | 4/1990 | Divnick |
| D320,299 | S | | 9/1991 | Beiter |
| D433,736 | S | | 9/1991 | Beiter |
| D324,751 | S | | 3/1992 | Perkitny |
| D329,933 | S | | 9/1992 | Perkitny |
| D359,832 | S | | 6/1995 | Woolrich |
| 5,437,408 | A | | 8/1995 | Chesnut |
| 5,888,115 | A | | 3/1999 | Shoemaker, Jr. |
| 5,911,299 | A | | 6/1999 | Aspnes |
| 6,551,183 | B2 | | 4/2003 | Knox, Jr. |
| D477,452 | S | | 7/2003 | Chia |
| 6,651,797 | B1 | | 11/2003 | Tree |
| D491,335 | S | | 6/2004 | Nwadike |
| 6,793,570 | B1 | | 9/2004 | Wekstein |
| D511,466 | S | | 11/2005 | Ogo |
| D514,770 | S | | 2/2006 | Henderson |

* cited by examiner

*Primary Examiner*—Kien T Nguyen
(74) *Attorney, Agent, or Firm*—Jay Schloff

(57) ABSTRACT

Disclosed is a device for collecting and/or playing with circular and spherical objects. The device comprises: a base comprising an open top portion and a closed bottom portion; an open top main body comprising a rim portion, and a circular portion extending downwardly and inwardly from the rim portion to an aperture concentric with the rim portion and coupling with the open top portion of the base; a flange extending horizontally and outwardly about the rim portion; and at least one launching ramp mounted on the flange. Due to the mounting of the launching ramps on the flange the device is capable of accommodating the launching ramps outside the rim portion, that is, outside the outer circumference of the circular portion. Such an accommodation of the launching ramps provides the entire surface of the circular portion as a rolling surface for the circular and spherical objects.

20 Claims, 7 Drawing Sheets

DEVICE FOR COLLECTING AND PLAYING WITH CIRCULAR AND SPHERICAL OBJECTS WITH LAUNCHING RAMPS THEREON

FIELD OF THE INVENTION

The present invention relates to devices for collecting and/or playing with circular and spherical objects with launching ramps on the devices.

BACKGROUND OF THE INVENTION

Commonly, large funnel-shaped devices are used as apparatuses for demonstrating the principles of gravitational force and centrifugal force. When a circular or spherical object is launched tangentially from a guiding track on to an inner surface (i.e. a rolling surface) of the funnel-shaped device, the object gathers velocity during its descent along the guide path and the centrifugal force gathered thereby causes the object to roll along the inner surface of the device. At the same time, the gravitational force acts upon the rolling object, causing the object to roll downwards and inwards in a spiral path on the inner surface of the device, and ultimately, to drop out of the device. During the descent of the object along the inner surface of the funnel-shaped device, the object gathers velocity before exiting out of the narrow terminus of the funnel-shaped device. Such apparatuses are useful in teaching the basic principles of science to students and offer elements of entertainment and interactivity in the students' learning process.

Based on the same principles, "Wishing Wells" and "Coin Funnels" have also been devised and utilized for a plurality of reasons, such as fundraising purposes, amusement games, and the like. Such apparatuses may be installed in shopping malls, hospitals, museums, theaters, and retail stores, and other environments with pedestrian traffic to induce such pedestrians to deposit and deliver coinage into the apparatuses.

Such apparatuses generally have a guiding launch track for launching the circular or spherical objects onto a smooth trackless rolling surface. Various configurations of guiding launch tracks may be found in the prior art for launching the circular or spherical objects onto the rolling surface. U.S. Pat. No. 433,736 to Lockwood discloses a toy bank having a spiral ramp of several coils leading to a slot in the top of a drum-like base or container. U.S. Pat. No. 3,092,928 to Geiser discloses a toy for use with marbles, including an upper flat circular pan with a feed groove around its periphery leading to a tubular generally vertical track that discharges into a tangential extension of the top of an inverted conical base, so the marbles circle the base in decreasing circles an exit through a central bottom hole into a separate pan-like container.

When used for the purpose of amusement, the person playing the game may want the circular or spherical object dropped in the funnel-shaped device to remain rolling in the funnel as long as possible. This necessitates that the object utilize the maximum rolling surface available on the inner surface of the funnel-shaped device. U.S. Pat. No. Des 320,299 to Beiter discloses a "coin collector" with a guiding path disposed on the rolling surface for enabling a circular object to be launched onto the funnel-shaped device. Such a configuration decreases the rolling surface available for the objects to travel.

U.S. Pat. No. 5,911,299 to Aspnes discloses a "Vending Machine with Coin Entertainment" having a coin feed mechanism, in addition to other structural configurations, that drops the coin into a main chute and finally onto trackless and endless structure or vortex structure where the coin rolls in a spiral. This patent does not discuss the available rolling surface of the vortex structure for the coin to travel in a spiral path.

The available arts in the current domain have in common launch ramps that are mounted directly on the funnel surface, thereby limiting the available rolling surface to the area between the launch ramps. Therefore, the available arts are mostly silent in addressing the benefit of utilizing the maximum rolling surface for the swirling circular or spherical objects. Also, with the mounting of the launch ramps directly on the surface of the funnel, said ramps block the view of the coins rolling around the funnel surface. Moreover, the launch ramps in the prior art have uniformly sloped guiding track requiring longer launch ramps for exiting the coins at desired speed and angle. Such longer ramps require more material, resulting in higher manufacturing costs.

Accordingly, there remains a need for an amusement or collection device capable of providing a maximum rolling surface for such objects, and a more open view of such objects, while at the same time avoiding the complexities of configuration, manufacturing and assembly to provide an easy-to-use and inexpensive device.

SUMMARY OF THE INVENTION

In view of the foregoing disadvantages inherent in the prior art, the general purpose of the present invention is to provide a device for collecting and/or playing with circular and spherical objects configured to include all the advantages of the prior art, and to overcome the drawbacks of the prior art.

In one aspect, the present invention provides a device for collecting and/or playing with circular and spherical objects. The device comprises: a base comprising an open top portion and a closed bottom portion; an open top main body comprising a rim portion, and a circular portion extending downwardly and inwardly from the rim portion to an aperture concentric with the rim portion and coupling with the open top portion of the base; a flange extending horizontally and outwardly about the rim portion; and at least one launching ramp mounted on the flange. The open top main body is supported on the base along a common vertical central axis. The launching ramp extends upwardly and inwardly over the open top main body, the launching ramp comprising a curved guiding track extending downwardly towards the rim portion such that circular and spherical objects placed on the launching ramp roll down the curved guiding track and exit tangentially onto an inner surface of the circular portion along the rim portion and further through a downwardly and inwardly spiral path of decreasing radius on the inner surface of the circular portion into the aperture and down into the base.

Due to the mounting of the launching ramps on the flange extending horizontally and outwardly about the upper end of the rim portion the device is capable of accommodating the launching ramps outside the rim portion, and, more specifically, outside an outer circumference of the circular portion. Such an accommodation of the launching ramps makes available the entire surface of the circular portion as a rolling surface for the circular and spherical objects, i.e., the entire surface of the circular portion is unobstructed for purposes of rolling objects thereon.

In another aspect, the present invention provides a device for collecting and/or playing with circular and spherical objects comprising: a base comprising an open top portion and a closed bottom portion; an open top main body comprising a rim portion, and a circular portion extending downwardly and inwardly from the rim portion to an aperture concentric with the rim portion and coupling with the open top portion of the base; a flange extending horizontally and outwardly about the rim portion; and at least one launching ramp mounted on the flange. The open top main body is supported on the base along a common vertical central axis. The launching ramp extends vertically on the flange.

The launching ramp comprises a first ramp having a grooved guiding track extending downwardly and outwardly from a top to a bottom of the launching ramp, and further extending to a curved stepped region defining a curved guiding track and a curved wall. The curved guiding track forms a lower portion of the curved stepped region. The curved stepped region tapers inwardly and finally matches with the rim portion of the open top main body such that circular and spherical objects placed on the top of the launching ramp roll down the grooved guiding track and further onto the curved guiding track. Such objects exit tangentially onto an inner surface of the circular portion along the rim portion and further travel on a downwardly and inwardly spiral path of decreasing radius on the inner surface of the circular portion into the aperture and down into the base.

In another aspect, the present invention provides a launching device, comprising: a ramp comprising a top portion having a downwardly-extending placement wall surrounded by a first side wall and a second side wall, configuring a three-walled mouth placement region, and a bottom portion comprising a curved guiding track and a curved wall configuring a stepped region, the curved guiding track forming a lower portion of the stepped region; and a fence comprising a plate portion, and a curved arm extending from a bottom of the plate portion.

The plate portion rests over the top portion of the ramp to configure a four-walled mouth drop region in combination with the three-walled mouth placement region, and the curved arm rests over the bottom portion of the ramp covering at least a portion of the curved guiding track along a complete length of the curved guiding track; and wherein the launching device is mounted outside an outer circumference of a circular body extending downwardly and inwardly from the outer circumference to an aperture such that circular and spherical objects dropped into the four-walled mouth drop region roll down the curved guiding track and exit tangentially onto an inner surface of the circular body at the outer circumference and further through a downwardly and inwardly spiral path of decreasing radius on the inner surface of the circular body into the aperture.

These together with other aspects of the present invention, along with the various features of novelty that characterize the invention, are pointed out with particularity in the claims annexed hereto and form a part of this disclosure. For a better understanding of the invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention is not limited to a particular device for collecting and/or playing with circular and spherical objects, as shown and described. It is understood that various omissions, substitutions, and equivalents are contemplated as circumstances may suggest or render expedient, but it is intended to cover the application or implementation without departing from the spirit or scope of the claims of the present invention. The terms "a" and "an" herein do not denote a limitation of quantity, but rather denote the presence of at least one of the referenced item.

The present invention provides a device for collecting and/or playing with circular and spherical objects. As used herein, "circular and spherical objects" refer to small circular objects, such as coins, marbles, ball bearings, and the like. The device is a combination of a funnel-shaped portion and at least one launching ramp for launching the circular objects onto an inner surface of the funnel-shaped portion. The launching ramp is configured such that an entire inner surface of the funnel-shaped portion may be used as a rolling surface for circular objects. The present invention provides an easy-to-use and highly entertaining collection and/or playing device that may be positioned outside shopping malls, hospitals, museums, theaters, retail stores, and the like places, wherein they may be approached by adults and children in large numbers for a variety of purposes.

Figure 1:
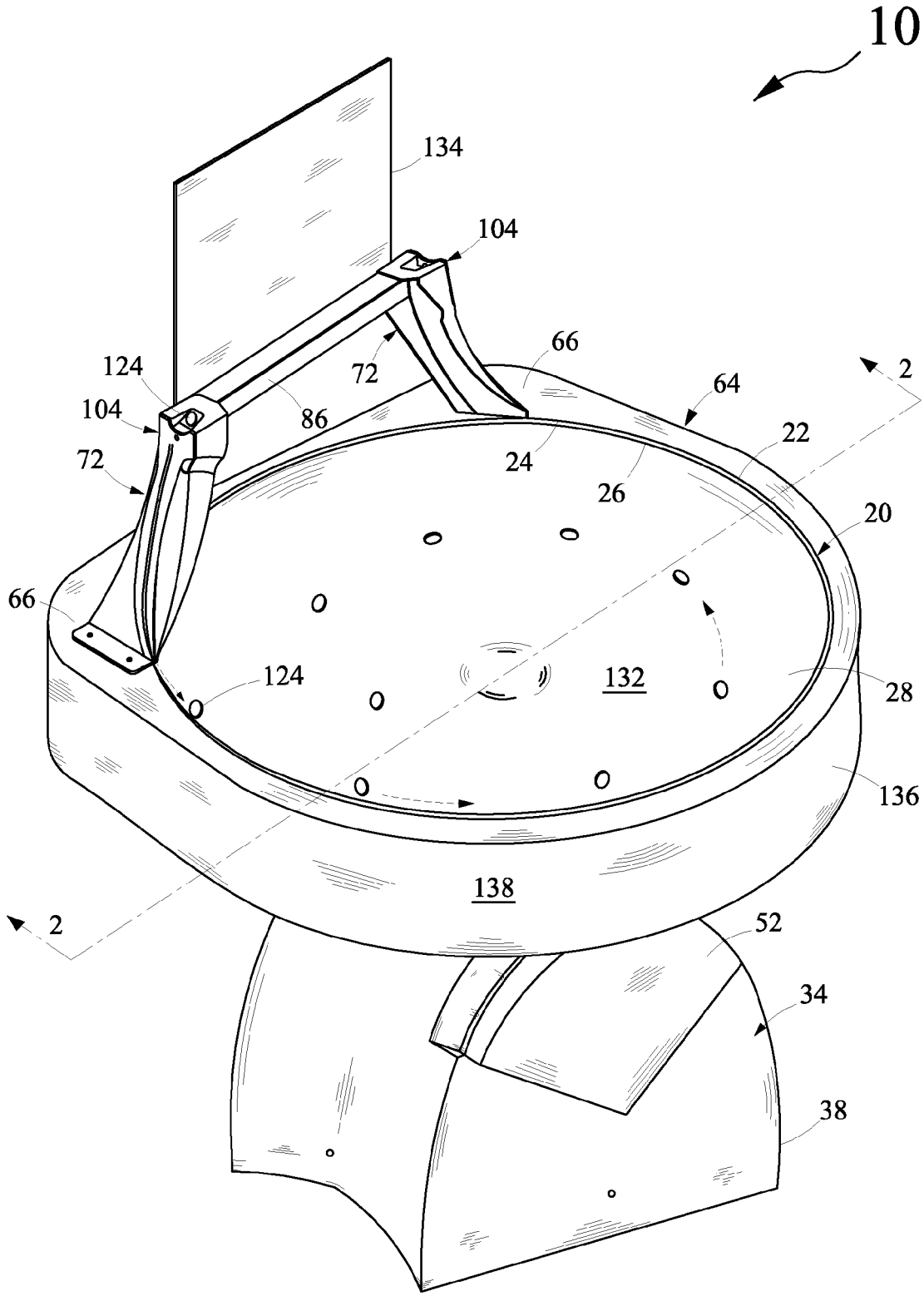
FIG. 1 is a perspective view of a device 10 for collecting and/or playing with circular and spherical objects, according to an embodiment of the present invention.
Figure 2:
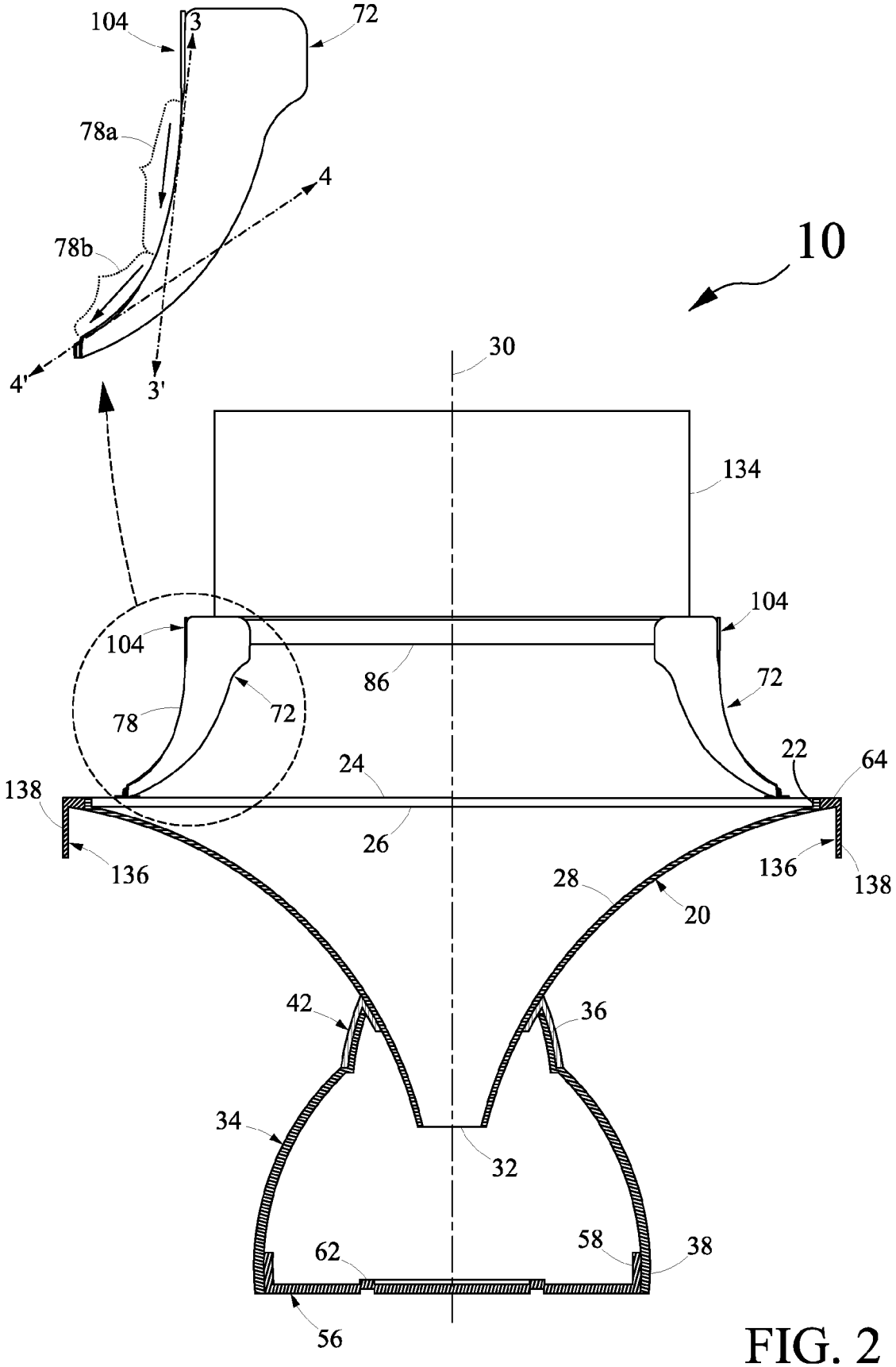
FIG. 2 is a cross-sectional view of the device 10 along line 2-2 of FIG. 1, according to an embodiment of the present invention.
Figure 3:
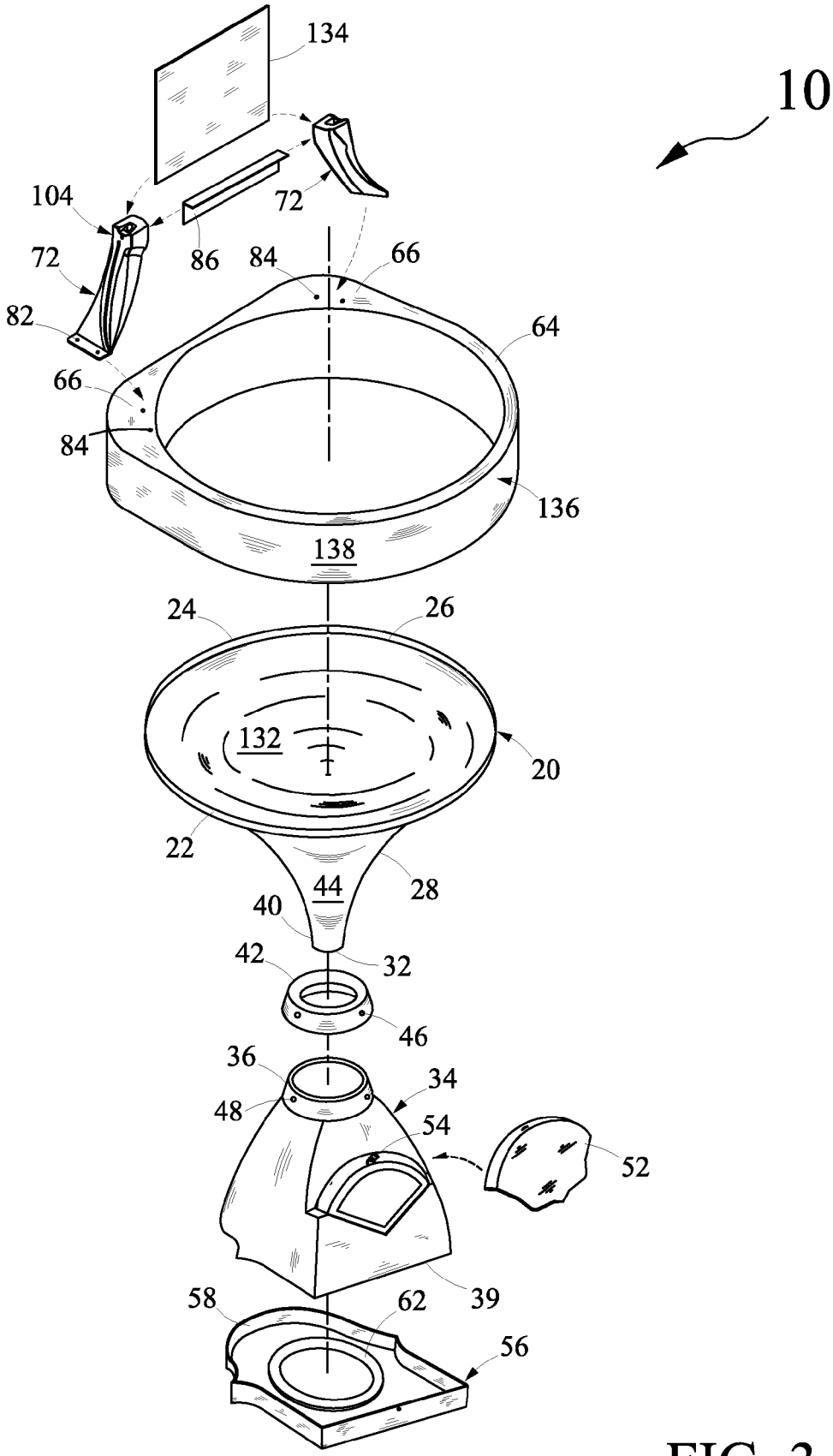
FIG. 3 is an exploded component perspective view of the device 10, according to an embodiment of the present invention.
Figure 5:
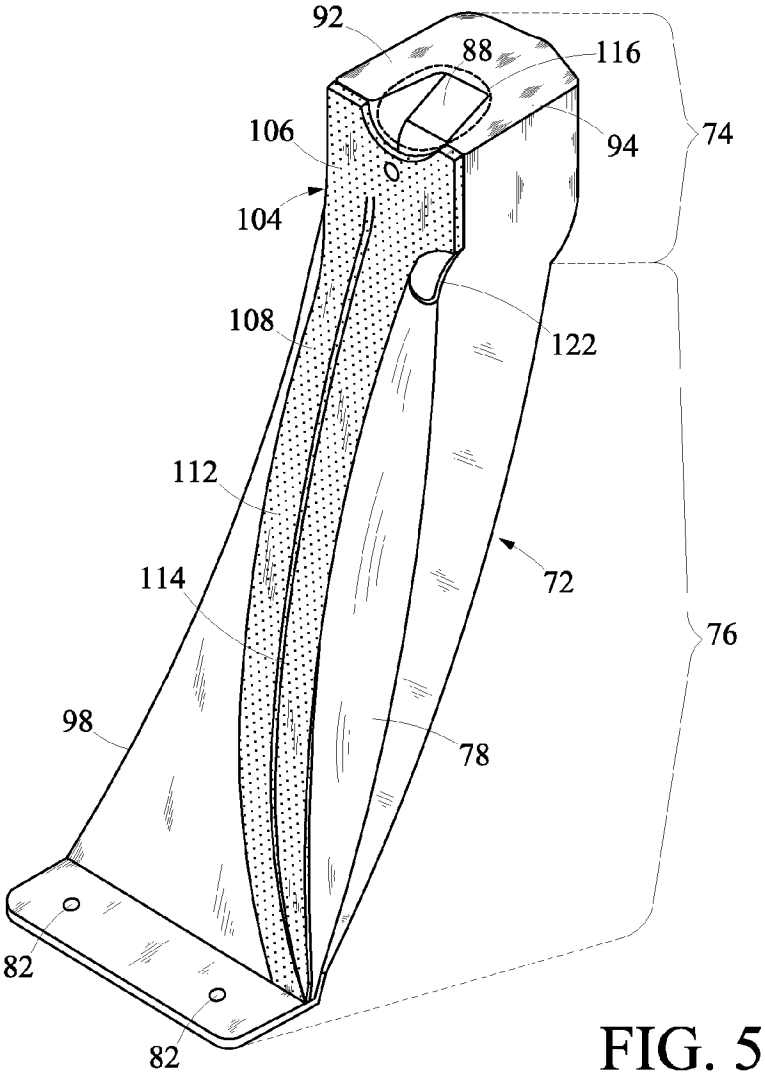
FIG. 5 is a perspective view of the launching ramp 72 and a fence 104 positioned over the launching ramp 72, according to an embodiment of the present invention.
Figure 4:
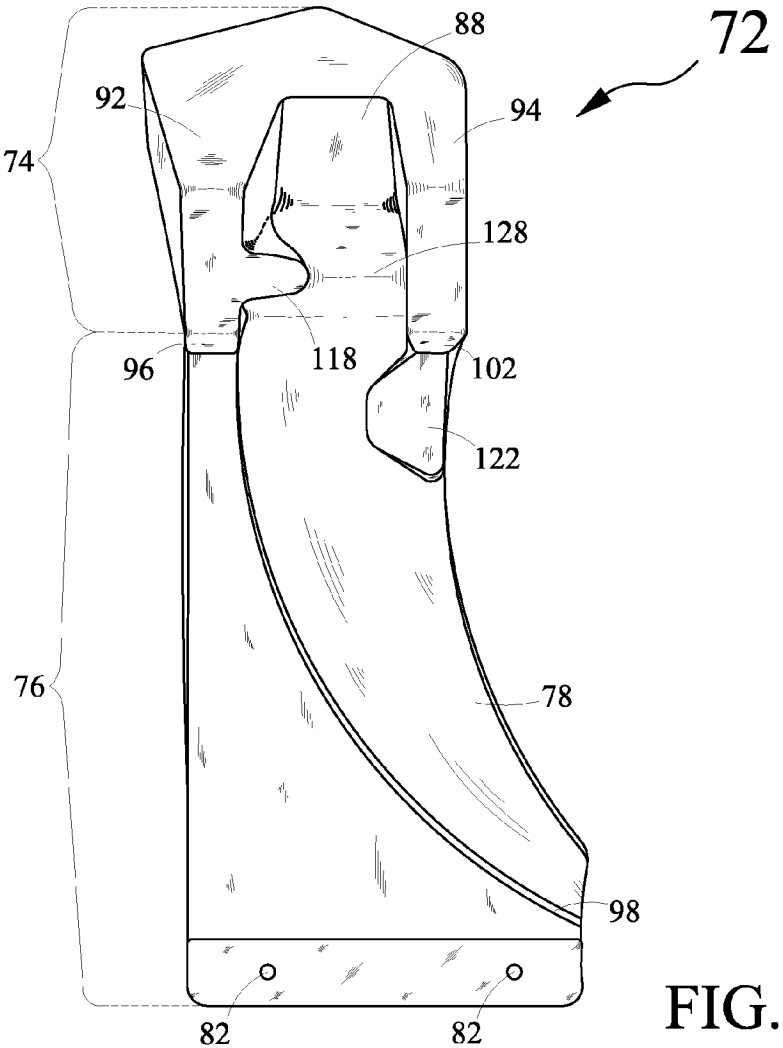
FIG. 4 is a front perspective view of a launching ramp 72, according to an embodiment of the present invention.
Figure 6B:
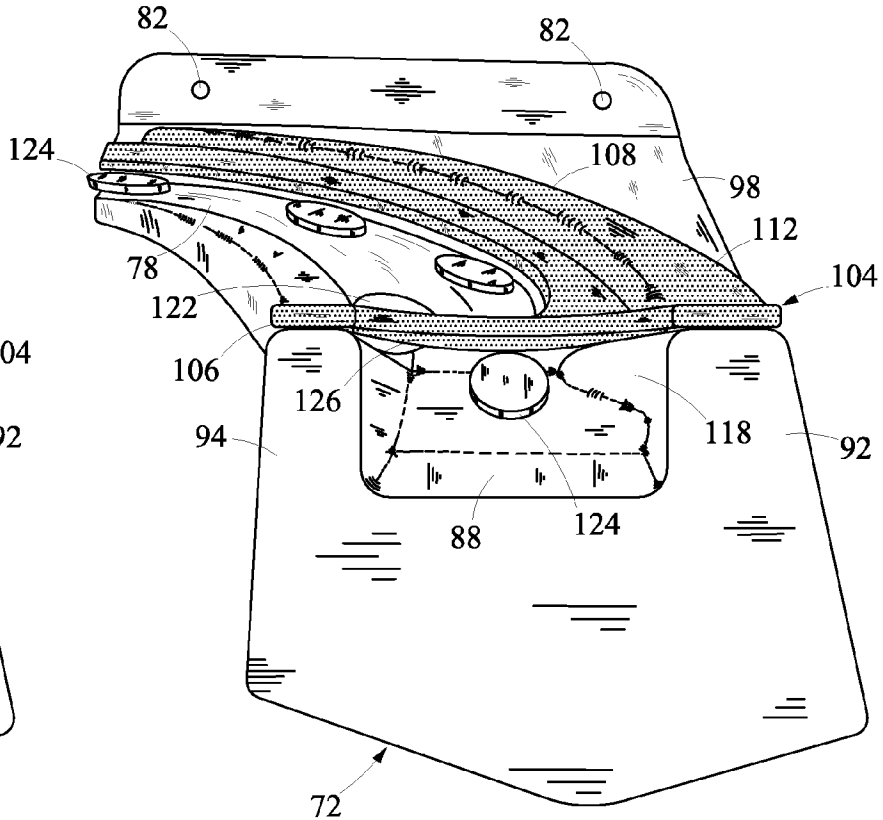
FIG. 6B is a top view of the launching ramp 72 and the fence 104 positioned over the launching ramp 72 illustrating the descent of a coin 124 through the launching ramp 72 and the fence 104, according to an embodiment of the present invention.
Figure 6A:
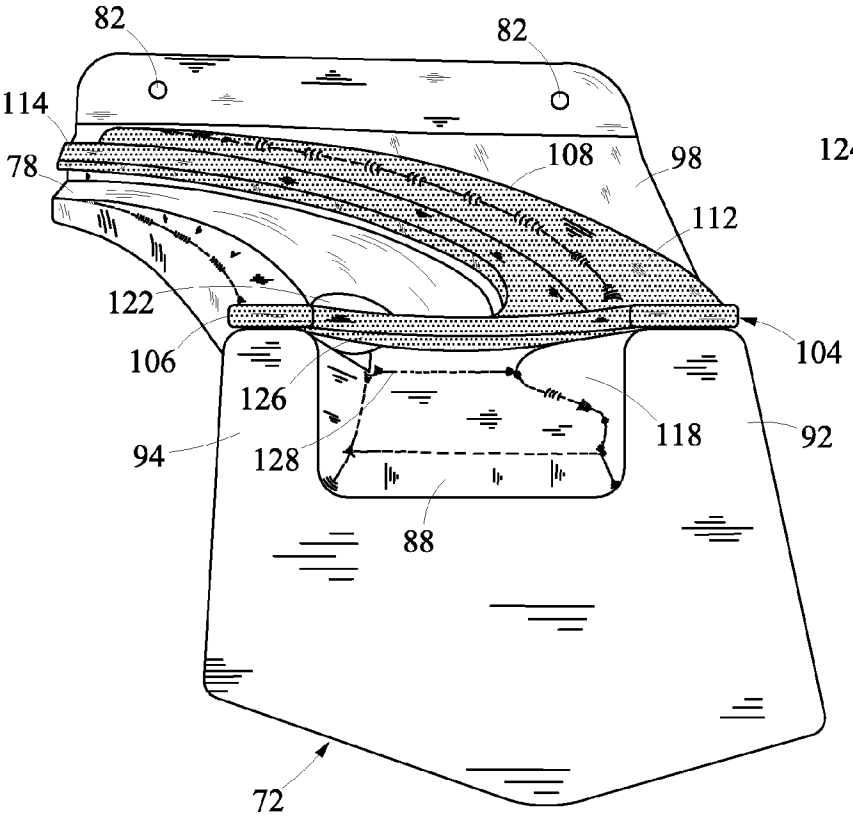
FIG. 6A is a top view of the launching ramp 72 and the fence 104 positioned over the launching ramp 72, according to an embodiment of the present invention.

Referring to FIGS. 1-3, in one embodiment, a device 10 for collecting and/or playing with circular and spherical objects is shown. The device 10 comprises an open top main body 20 having rim portion 22 and a circular portion 28. The rim portion 22 is a vertically extending circular rim defining an upper end 24 and a lower end 26. The circular portion 28 extends downwardly and inwardly from the lower end 26 of the rim portion 22 to an aperture 32 concentric with the rim portion 22. More specifically, the circular portion 28 is in the form of a "vortex-funnel-shaped portion" with convex side-walls having a decreasing diameter from the lower end 26 of the rim portion 22 to the aperture 32, around a vertical central axis 30.

The rim portion 22 in the form of a circular raised structure at an outer circumference of the circular portion 28 serves to guard against an errant circular or spherical object from spinning off the circular portion 28 and falling to the floor. Additionally, small objects such as marbles and ball bearings may be rolled along the rim portion 22 as a part of scientific experimentation (for example, in the illustration of orbit observations). Although, as envisioned herein that the open top main body 20 comprises the rim portion 22 as a vertically extending circular rim, the open top main body 20 may have the circular portion 28 with a rim portion of an insignificant height and merely forming the outer circumference of the circular portion 28.

The open top main body 20 is supported on a base 34 along the common vertical central axis 30. The base 34 has a container-like shape for storing circular and spherical objects that are dropped onto the device 10. The base 34 has an open top portion 36 and a generally flat closed bottom portion 38. A lower end portion 40 of the circular portion 28 near the aperture 32 couples with the open top portion 36 of the base 34 such that the open top main body 20 is held in an upward facing position with the rim portion 22 at the top in a level horizontal plane and the aperture 32 at the bottom. The device 10 may comprise an intermediate component coupling the lower end portion 40 to the open top portion 36 of the base 34. For example, a ring 42 may be bonded (welded, cemented or adhesively bonded) to an outer surface 44 of the circular portion 28 at the lower end portion 40. The ring 42 may be received on the open top portion 36 of the base 34 and fastened thereto. More specifically, the ring 42 may have a first pair of through holes 46 that align with a second pair of through holes 48 on the open top portion 36 of the base 34, and be fastened thereto by passing fasteners (for example, bolts, screws, and the like) through the first pair of though holes 46 and the second pair of through holes 48.

Alternatively, the lower end portion 40 and the open top portion 36 may have interfitting or telescoping coupling features for holding the open top main body in the upward-facing position. For example, an inner surface of the lower end portion 40 may include a set of internal threads that engage with a set of external threads on an external surface of the open top portion 36. Alternatively, in cases where the open top main body 20 and the base 34 are made from a same material, the base 34 may be welded to the open top main body 20 or the base 34 and the open top main body 20 may be molded as a single-piece structure.

Additionally, the base 34 has an access feature for retrieving the contents, i.e., the circular and spherical objects collected inside the base 34. The access feature may be in the form of a door 52 and a lock 54 that allows easy retrieval of the contents and enables secure storage before the contents are retrieved by authorized personnel.

Optionally, the closed bottom portion 38 has a centrally located raised ring structure (not shown) thereby providing a secure area for a circular and spherical object collection bucket (not shown) housed inside the base 34. The secure area prevents the collection bucket from sliding out from under the lower end portion 40 of the circular portion 28. The base 34 has features (for example, the raised ring structure) that aid in stackable shipping and storage of a plurality of the devices, thereby saving space. Alternatively, the device 10 further has a floor 56 that may be removably attached (bolted) with a bottom 39 of the base 34 to form the closed bottom portion 38. The floor 56 may have a raised skirt 58 that may be received within the bottom 39 of the base 34, and bolted thereto. The floor 58 further has a centrally located raised ring structure 62, providing a secure area for a circular and spherical object collection bucket housed inside the base 34.

The device 10 further comprises a flange 64 extending horizontally and outwardly about the upper end 24 of the rim portion 22. The flange 64 may have a width sufficient to accommodate at least one launching ramp 72 (generally referred to as a "ramp") for launching circular and spherical objects onto the circular portion 28. The launching ramp 72 extends upwardly. More specifically, the flange 64 may extend sufficiently to form mounting platforms 66 at corners for accommodating launching ramps 72. The flange 64 extending to form mounting platforms 66 at corners is designed such that the overall width of the device 10 is not increased. Such a design involving extension of the generally circular shaped flange 64 of the device 10 to form corners does not require additional space for shipping in boxes or storage that is required by the manifestation of the device that lacks such mounting platforms. Also, such a design does not result in increasing the overall diameter of the device 10 and does not necessitate using any additional floor space with the presence of the mounting platforms 66. Additionally, by mounting the launching ramps 72 in the corners, the launching ramps 72 do not block the view of the circular or spherical objects circling on the circular portion 28.

Due to the mounting of the launching ramps on the flange 64 that extend horizontally and outwardly about the upper end 24 of the rim portion 22, and, more specifically, on the mounting platforms 66, the device 10 is capable of accommodating the launching ramps 72 outside the rim portion 22, and, more specifically, outside the outer circumference of the circular portion 28. Such an accommodation of the launching ramps 72 permits the entire surface of the circular portion 28 to be used as a rolling surface for the circular and spherical objects, i.e., the entire surface of the circular portion 28 is unobstructed for rolling objects thereon. The accommodation of the launching ramps 72 finds significance in maximizing the number of rotations of the objects as they descend on an inner surface 132 of the circular portion 28.

Another use of the device 10 arising from the availability of the entire inner surface 132 of the circular portion 28 being unobstructed is for rolling small objects such as marbles and ball bearings as a part of scientific experimentation (for example, illustration of orbit observations). A ball bearing held in hand may be launched onto the circular portion 28, similar to the launch of a ball onto a roulette wheel. The ball bearing will roll on the circular portion 28 for several revolutions, until the momentum has decreased to the point that gravitational force on the ball bearing exceeds centrifugal force, and then will follow a downward and inward spiral path of decreasing radius on the circular portion 28 into the aperture 32. Such mounting generally results in the launching ramps being mounted on a back or a front side of the device 10, so that the visibility of the travel of the circular and spherical objects on the circular portion 28 is not obstructed.

For example, as shown in FIGS. 1-3, the device 10 has two launching ramps 72 removably mounted on two mounting platforms 66 on a back side of the device 10. The launching ramps 72 extend upward and inward over the open top main body 20, towards the vertical central axis 30.

Referring to FIGS. 4, 5, 6A, and 6B the launching ramp 72 has a top portion 74 for placement of circular objects and for guiding the circular objects to a bottom portion 76 having a curved guiding track 78. The launching ramps 72 may be mounted using a first pair of through holes 82 on the bottom portion 76 of the launching ramp 72 that align with a second pair of through holes 84 on the mounting platform 66, and fastened thereto using fasteners (for example, blots, screws, and the like) passing through the first pair of though holes 82 and the second pair of through holes 84. The device 10 may further comprise an intermediate bracket 86 (See FIGS. 1-3) coupling the launching ramps 72, thereby providing structural support to the launching ramps 72. The intermediate bracket 86 may be welded, cemented or adhesively bonded to the back surface of the top portions 74 of the launching ramps 72. Alternatively, the two launching ramps 72 and the intermediate bracket 86 may be molded as a single-piece structure.

The curved guiding track 78 extends downwardly along a curve of decreasing slope towards the rim portion 22. More specifically, as shown in FIG. 2, the curved guiding track 78 has an upper portion 78*a* steeper than a lower portion 78*b*, thereby providing a dual angle feature having a first angle of descent along line 3-3' and a second angle of descent along line 4-4'. The circular and spherical objects gain the required speed descending down the upper portion 78*a* (i.e., the steeper portion of the curved guiding track 78 providing the first angle of descent along line 3-3'); and further descend down the lower portion 78*b* (i.e., the less steep portion of the curved guiding track 78 providing the second angle of descent along line 4-4').

The design of the curved guiding track 78 incorporating the dual angle feature improves the functionality of the launching ramps 72, and of the overall device 10 as compared to launching ramps that feature a guiding track with almost a uniformly sloped surface and a single angle of descent. The improved functionality results from the fact that the dual angle feature allows for the incorporation of a shorter launching ramp 72 in the device 10, thereby requiring less material (i.e., lower manufacturing costs) as compared to devices lacking the dual angle feature.

Furthermore, such shorter launching ramps 72 are not required to extend as high to impart the desired speed to the launched object as are launching rams that lack the dual angle feature. A shorter launching ramp improves the functionality for the end user, in that, for example, the shorter launching ramps 72 are naturally more accessible to children and other shorter individuals.

The top portion 74 has a downwardly extending placement wall 88 surrounded by a first side wall 92, and a second side wall 94, thereby forming a three-walled "mouth" placement region for receiving circular and spherical objects and for guiding the objects towards the curved guiding track 78.

The launching ramp 72 has a first ledge 96 extending outwardly from a bottom of the first side wall 92 and a curved wall 98 extending downwardly from the first ledge 96 about a complete length of the curved guiding track 78. The curved wall 98 along with the curved guiding track 78 configures a stepped region. The curved guiding track 78 forms a lower portion of the stepped region. Similarly, a second ledge 102 extends outwardly from a bottom of the second side wall 94.

The device 10 may further comprise a fence 104 having a plate portion 106 and a curved arm 108 extending from a bottom of the plate portion 106. The curved arm 108 has a cover region 114 and a wall region 112 configuring a stepped region. The cover region 114 forms a lower portion of the stepped region. The fence 104 may be positioned over the launching ramp 72 such that the bottom of the plate portion 106 sits over the first and second ledges 96, 102, while the wall region 112 rests upon the curved wall 98 and the cover region 114 covers at least a portion of the curved guiding track 78.

When the fence 104 is in the above-mentioned position, the plate portion 106 of the fence 104 in combination with the three-walled mouth placement region configures a four-walled mouth drop region 116 (See FIG. 5) for receiving the circular objects. The circular objects may be dropped in the four-walled mouth drop region 116 in addition to placing the circular object, thereby providing an easy-to-use circular and spherical object drop region. Such a four-walled mouth drop region 116 allows users to drop a plurality of such objects at once. Also, the stepped curved arm 108, and, more specifically, the cover region 114 aids in keeping the circular and spherical objects on the curved guiding track 78, as the objects descend down through the space between the curved guiding track 78 and the cover region 114.

The fence 104 may be bonded to the launching ramp 72 in the above-mentioned position using suitable bonding techniques including, but not limited to, thermal bonding, ultrasonic bonding, adhesive bonding, cementing and welding. Alternatively, the fence 104 has engagement features for attachment with complementary engagement features on the launching ramp 72.

The launching ramp 72 may further comprise at least one raised structural feature (lug(s), wedge(s), stud(s), protrusion (s), lip(s), and the like) disposed on the top portion 74 and/or the bottom portion 76 of the launching ramp 72 providing deflection surfaces for directing the circular and spherical objects towards the curved guiding track 78, so that the circular and spherical objects may begin their descent at the same position every time so they achieve the required speed to perform on the inner surface 132 of the circular portion 28. For example, the launching ramp 72 has a first lug 118 disposed on the top portion 74 of the launching ramp 72. The first lug 118 extends from an intermediate portion of the first side wall 92 towards the three-walled mouth placement region. A second lug 122 may be disposed on the bottom portion 76 of the launching ramp 72. The second lug 122 extends from the second ledge 102 towards the curved guiding track 78.

Referring again to FIGS. 1 and 6B, a circular object, herein a coin 124 is shown being dropped into the four-walled mouth drop region 116. The placement wall 88 may have a label or sticker with the text, such as, "Drop Coins Here," instructing the users to drop or place the coins over the label or sticker. When the coin 124 hits the placement wall 88, the sloping of the placement wall 88 may force the coin 124 against the inner surface 126 of the fence 104. Optionally, the launching ramp 72 further comprises a deflecting surface 128 extending outwardly from bottom of the placement wall 88 for further forcing the coin 124 against the fence 104. While traveling further down the top portion 74 of the launching ramp 72, the first lug 118, if required, deflects the coin 124 towards an intermediate portion of the three walled placement region. Next, while traveling further down the launching ramp 72, the second lug 122, if required, deflects the coin 124 towards the curved guiding track 78. Alternatively, the coin 124 when dropped into the four-walled mouth drop region 116 may directly hit the second lug 122 and get deflected towards the curved guiding track 78.

Accordingly, the coin 124 placed on the three-walled mouth placement region or dropped onto the four-walled mouth drop region 116 rolls down the curved guiding track 78 and exits onto the inner surface 132 of the circular portion 28 along the rim portion 22 (as illustrated in FIG. 1). Due to gravitational force, the coin 124 follows a downward and inward spiral path of decreasing radius on the inner surface 132 of the circular portion 28 into the aperture 32 and down into the base 34. Due to the presence of the walls (i.e., the placement wall 88, and the first and second side walls 92, 94), the raised structural features (i.e., the first lug 118 and the second lug 122), the optional deflection surfaces (i.e., the deflecting surface 128), and the curved guiding track 78, the circular and spherical objects exit the launching ramp 72 at a required and uniform speed, rotation, and launch angle.

The open top main body 20 may be made of a material providing structural integrity to the device 10, while also providing an aesthetic appearance to the device 10. Suitable materials include, but are not limited to, resins, plastics, fibers, metal, and the like, as well as combinations comprising at least one of the foregoing. For example, the open top main body 20 can be made of automotive strength fiberglass. The launching ramps 72 may be made of a material providing a consistent rolling surface for the circular objects, while also providing an aesthetic appearance to the device 10. Suitable thermoplastic materials include, but are not limited to, polyolefins, polyesters, polyamides, polyvinyl chloride, polybutylene terephthalate, and acrylonitrile butadiene styrene (ABS).

Additionally, aesthetic decorations and/or designs, product or manufacturer information, source identifiers, messages, logos, and the like may be disposed on one or more surfaces of the device 10 for advertising, sponsorship messaging purposes and to otherwise provide additional revenue-generating information. For example, as shown in FIGS. 1-3, a placard or a sign frame 134 may be supported on lip(s), ledge(s), and similar structural features on a back side of the launching ramps 72. The device 10 may further comprise a skirt 136 extending downwardly preferably from an outer periphery of the flange 64. The skirt 136 provides an outer surface 138 for disposing messages and logos.

Figure 7:
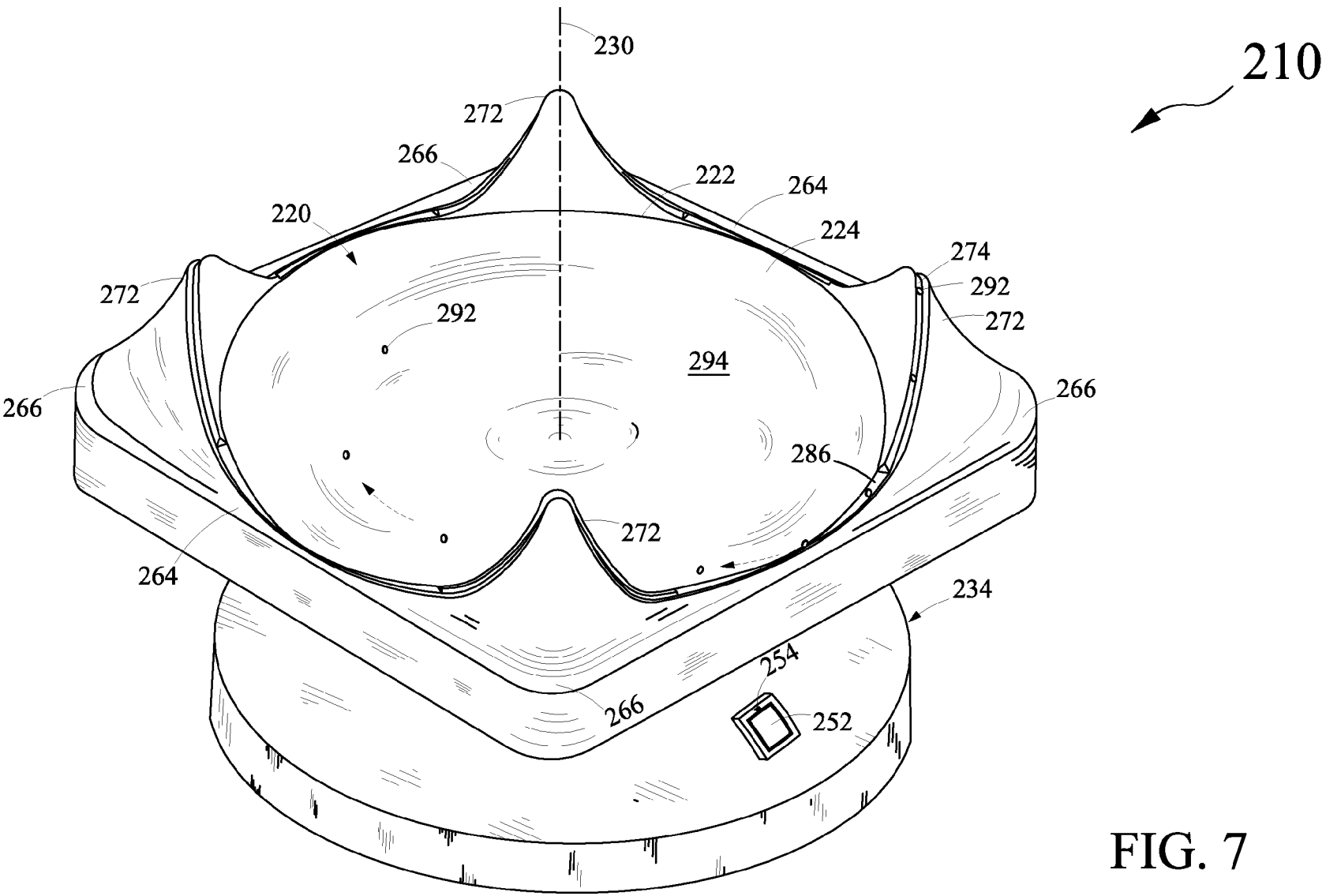
FIG. 7 is a perspective view of a device 210 for collecting and/or playing with circular and spherical objects, according to an embodiment of the invention.
Figure 8:
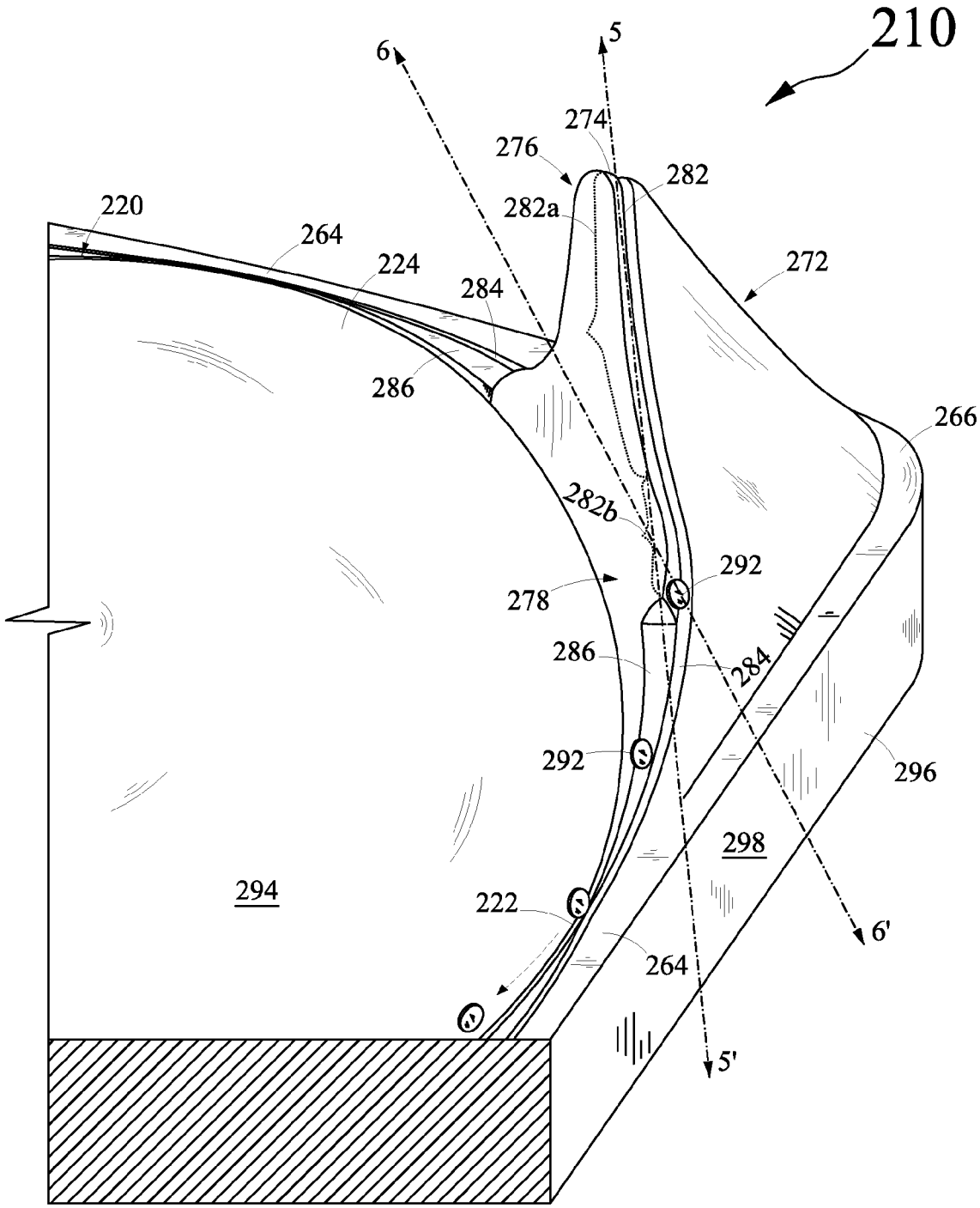
FIG. 8 is a partial enlarged perspective view of the device 210, according to an embodiment of the invention.

Referring to FIGS. 7 and 8, in another embodiment, a device 210 for collecting and/or playing with circular and spherical objects is shown. The device 210 comprises an open top main body 220 comprising a rim portion 222 and a circular portion 224. The circular portion 224 extends downwardly and inwardly from the rim portion 222 to an aperture (not shown) concentric with the rim portion 222. More specifically, the circular portion 224 is in the form of a vortex-funnel-shaped portion having a decreasing diameter from the rim portion 222 to the aperture, around a vertical central axis 230. The rim portion 222 may have an insignificant height and as shown in FIGS. 7 and 8 is an outer circumference of the circular portion 224.

The open top main body 220 is supported on a base 234 along the common vertical central axis 230. The base 234 has a container-like shape for storing circular and spherical objects that are dropped into and onto the device 210. The base 234 has an open top portion (not shown) and a generally flat closed bottom portion (not shown). A lower end portion of the open top main body 220 near the aperture couples with the open top portion of the base 234 such that the open top main body 220 is held in an upward facing position with the rim portion 222 at the top in a level horizontal plane and the aperture at the bottom. Preferably, the base 234 may be welded to the open top main body 220 or the base 234 and the open top main body 220 may be molded as a single-piece structure. Alternatively, the device 210 may comprise intermediate components or telescoping coupling features for coupling the lower end portion of the open top main body 220 with the open top portion of the base 234.

Additionally, the base 234 has an access feature for retrieving contents, i.e., the circular and spherical objects collected inside the base 234. For example, the access feature is in form of a door 252 and a lock 254 that allow easy retrieval of the contents and enables secure storage before the contents are retrieved by authorized personnel.

The device 210 further comprises a flange 264 extending horizontally and outwardly about the rim portion 222. The flange 264 may have a width sufficient to accommodate at least one launching ramp 272 for launching circular and spherical objects onto the open top main body 220. More specifically, the flange 264 may extend sufficiently to form mounting platforms 266 at corners for accommodating the launching ramps 272. The flange 264 extending into the mounting platforms 266 at corners is designed such that the overall width of the device 210 is not increased. Such a design involving extension of the flange 264 at the corners does not require additional space, for shipping in boxes or storage that is required by the manifestation of the device that lacks such mounting platforms 266. Moreover, such a design does not result in increasing the overall diameter of the device 210; and does not necessitate using any additional floor space with the presence of the mounting platforms 266.

Due to the mounting of the launching ramps on the flange 264 extending horizontally and outwardly about the upper end of the rim portion 222, and, more specifically, on the mounting platforms 266, the device 210 is capable of accommodating the launching ramps 272 outside the rim portion 222 of the open top main body 220. Such an accommodation of the launching ramps 272 permits the entire surface of the circular portion 224 to serve as a rolling surface for the circular and spherical objects, i.e., the entire surface of the circular portion 224 is unobstructed for rolling objects thereon. The accommodation of the launching ramps 272 finds significance in maximizing the number of rotations of the circular and spherical objects while they descend on an inner surface 294 of the circular portion 224.

Another use of the device 210 due to the availability of the entire inner surface 294 of the circular portion 224 being unobstructed is for rolling small spherical objects such as marbles and ball bearings as a part of scientific experimentation and orbit observations. A ball bearing held in hand may be launched on the open top main body 220, similar to the launch of a ball onto a roulette wheel. The ball bearing will roll on the circular portion 224 for several revolutions, until the momentum has decreased to the point that gravitational force on the ball bearing exceeds centrifugal force, and then will follow a downward and inward spiral path of decreasing radius on the circular portion 224 into the aperture.

For example, as shown in FIG. 7, the device 210 has four launching ramps 272 disposed on four mounting platforms 266 on four corners of the device 210. The launching ramps 272 extend vertically on the mounting platforms 266.

The launching ramps 272 have a placement region 274 at a top 276 for placement of circular and spherical objects; and a first ramp in the form of a grooved guiding track 282 extending downwardly and outwardly along a curve of decreasing slope from the top 276 to a bottom 278 of the launching ramps 272. The grooved guiding track 282 has an upper portion **282*a* steeper than a lower portion 282*b*. The angle of descent along the upper portion 282*a* is represented by line 5-5'. The lower portion 282*b* has a wall along which the circular and spherical objects rest while exiting from the grooved guiding track 282. More specifically, the angle of a circular object is along the wall of the lower portion 282*b*, as represented by line 6-6'. The first ramp further extends as a curved stepped region from the lower portion 282*b* of the grooved guiding track 282, the curved stepped region extending substantially along a plane of the flange 264. The curved stepped region defines a curved wall 284 and a curved guiding track 286. The curved guiding track 286 forms a lower portion of the curved stepped region. The curved stepped region tapers inwardly and finally matches with the rim portion 222 of the device 210, i.e., the first ramp finally matches with the open top main body 220** substantially along a tangent thereto.

The circular and spherical objects gain the required speed descending down the upper portion 282*a*; and further descend down the lower portion 282*b*, and further along the curved guiding track 286 to exit the launching ramps 272 at a uniform angle. Accordingly, the grooved guiding track 282 provides an initial steeper portion for circular and spherical objects to gain the required speed, and a final less steep portion extending to the curved stepped region and finally matching with the open top main body 220 for exiting the circular and spherical objects at uniform angles onto the inner surface 294 of the circular portion 224.

The design of the first ramp improves the functionality of the launching ramps 272, and of the overall device 210 as compared to launching ramps having a ramp design with almost a uniformly sloped surface and a single angle of descent. The improved functionality results from the fact that the present ramp design allows for the incorporation of a shorter launching ramp 272 in the device 210 thereby requiring less material (i.e., lower manufacturing costs) as compared to devices without the present ramp design.

Furthermore, such shorter launching ramps 272 are not required to extend as high to impart the desired speed to the launched object as are launching ramps that lack the present design of the launching ramps 272. A shorter launching ramp improves the functionality for the end user, in that, for example, the shorter launching ramps 272 are naturally more accessible to children and other shorter individuals.

Due to the launching ramps 272 extending vertically on the mounting platforms 266 and the ramp design, the open top main body 220, the flange 264 and the launching ramps 272 may be molded as a single piece structure in an efficient and cost-effective manner. Such a manufacturing approach of molding the entire device 210 as a single piece structure results in a considerable reduction in manufacturing costs, while simultaneously providing a more durable and professional product.

Referring again to FIGS. 7 and 8, a circular object, herein a coin 292, is shown placed on the placement region 274 and further rolling in direction of the arrow. The placement region 274 may have a label or sticker with the text, such as "Place Coins Here," instructing the users to place the coins over the label or sticker. The coin 292 placed on the placement region 274 rolls down the grooved guiding track 282 and further on the curved guiding track 286, and finally exits onto the inner surface 294 of the circular portion 224 along the rim portion 222. Due to gravitational force, the coin 292 follows a downwardly and inwardly spiral path of decreasing radius on the open top main body 220 into the aperture and down into the base 234. To provide further assistance to the user in launching coins, an open mouth coin-drop area can be created by adding to the ramp a fence similar to the fence 104 depicted in FIG. 5. The addition of such a fence can make the object launch process easier for children users.

In addition to the first ramp, the launching ramps 272 have a second ramp structurally similar to the first ramp on an opposite side of the first ramp. Accordingly, each of the launching ramps 272 may launch circular objects in two directions, i.e., clockwise and counter-clockwise directions. For example, a total of eight circular objects may be launched at a time using the device 210 having four launching ramps 272 with each launching ramp 272 having two oppositely directed ramps. Accordingly, eight users may play a racing game by launching circular objects (coins) at the same time. Such a launching of multiple circular objects at the same time may provide a lot of fun, excitement, and educational experimental value to the users.

Additionally, aesthetic decorations and/or designs, product and manufacturer information, source identifiers, messages and logos, and the like may be disposed on one or more surfaces of the device 210 for advertising, sponsorship and messaging purposes and to otherwise provide additional revenue generation information. For example, a placard or a sign frame may extend across a diameter of the open top main body 220 and be supported on two diagonally opposite launching ramps 272. The device 210 may further comprise a skirt 296 extending downwardly preferably from an outer periphery of the flange 264. The skirt 296 provides an outer surface 298 for disposing messages and logos.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, and to thereby enable others skilled in the art to best utilize the invention and various embodiments with various modifications as are suited to the particular use contemplated. It is understood that various omissions, substitutions, and equivalents are contemplated as circumstances may suggest or render expedient, but it is intended to cover the application or implementation without departing from the spirit or scope of the claims of the present invention.

Call Out List: Device for Collecting and Playing with Circular and Spherical Objects with Launching Ramps Thereon

| | |
|---|---|
| 10 | device |
| 20 | open top main body |
| 22 | rim portion |
| 24 | upper end of rim portion 22 |
| 26 | lower end of rim 22 |
| 28 | circular portion |
| 30 | vertical central axis |
| 32 | aperture |
| 34 | base |
| 36 | open top portion of the base 34 |
| 38 | closed bottom portion of the base 34 |
| 39 | bottom of the base 34 |
| 40 | lower portion of the circular portion 28 |
| 42 | ring |
| 44 | outer surface of the circular portion 28 |
| 46 | first pair of through holes on ring 42 |
| 48 | second pair of through holes on open top portion 36 |
| 52 | door |
| 54 | lock |
| 56 | floor |
| 58 | skirt |
| 62 | raised ring structure |
| 64 | flange |
| 66 | mounting platform(s) |
| 72 | launching ramp(s) |
| 74 | top portion of the launching ramp 72 |
| 76 | bottom portion of the launching ramp 72 |
| 78 | curved guiding track |
| 78a | upper portion |
| 78b | lower portion |
| 82 | first pair of through holes on the bottom portion 76 |
| 84 | second pair of through holes on mounting platform 66 |
| 86 | intermediate bracket |
| 88 | placement wall |
| 92 | first side wall |
| 94 | second side wall |
| 96 | first ledge |
| 98 | curved wall |
| 102 | second ledge |
| 104 | fence |

-continued

| | |
|---|---|
| 106 | plate portion of the fence 98 |
| 108 | curved arm of the fence 98 |
| 112 | wall region of the curved arm 106 |
| 114 | cover region of the stepped curved arm 106 |
| 116 | four-walled drop region |
| 118 | first lug |
| 122 | second lug |
| 124 | coin |
| 126 | inner surface of fence 104 |
| 128 | deflecting surface |
| 132 | inner surface of the circular portion 28 |
| 134 | sign frame |
| 136 | skirt |
| 138 | outer surface of skirt 136 |
| 210 | device |
| 220 | open top main body |
| 222 | rim portion |
| 224 | circular portion |
| 230 | vertical central axis |
| 234 | base |
| 252 | door |
| 254 | lock |
| 264 | flange |
| 266 | mounting platform(s) |
| 272 | launching ramp |
| 274 | placement region |
| 276 | top |
| 278 | bottom |
| 282 | grooved guiding track |
| 282a | upper portion |
| 282b | lower portion |
| 284 | curved wall |
| 286 | curved guiding track |
| 292 | coin |
| 294 | inner surface of the circular portion 224 |
| 296 | skirt |
| 298 | outer surface |

What is claimed is:

1. A device for collecting and/or playing with circular and spherical objects, comprising:

a base comprising an open top portion and a closed bottom portion;

an open top main body comprising a rim portion, and a circular portion extending downwardly and inwardly from the rim portion to an aperture concentric with the rim portion and coupling with the open top portion of the base, wherein the open top main body is supported on the base along a common vertical central axis;

a flange extending horizontally and outwardly about the rim portion; and at least one launching ramp mounted on the flange, the launching ramp extending upwardly, such that the at least one ramp is configured outside the outer circumference of the circular portion, the launching ramp comprising a curved guiding track extending downwardly along a curve of decreasing slope towards the rim portion, such that circular and spherical objects placed on the launching ramp roll down the curved guiding track and exit tangentially onto an inner surface of the circular portion along the rim portion and further through a downwardly and inwardly spiral path of decreasing radius on the inner surface of the circular portion into the aperture and down into the base.

2. The device of claim 1, wherein the circular and spherical objects comprise at least one of coins, marbles, and ball bearings.

3. The device of claim 1, wherein the launching ramp comprises a a top portion having a downwardly extending placement wall surrounded by a first side wall and a second side wall to configure a three-walled mouth placement region, and a bottom portion comprising the curved guiding track and a curved wall configuring a stepped region, the curved guiding track forming a lower portion of the stepped region.

4. The device of claim 3, wherein at least one of the top portion and the bottom portion comprise at least one raised structural feature providing a deflecting surface for directing the circular and spherical objects towards the curved guiding track.

5. The device of claim 4, wherein the top portion of the launching ramp comprises a first lug extending from an intermediate portion of the first side wall towards three-walled mouth placement region.

6. The device of claim 4, wherein the bottom portion comprises a second lug extending from a bottom portion of the second side wall towards the curved guiding track.

7. The device of claim 3, further comprising a fence having a a plate portion, and a curved arm extending from a bottom of the plate portion, wherein the fence is positioned over the launching ramp, such that, the plate portion rests over the top portion of the launching ramp to configure a four-walled mouth drop region in combination with the three-walled mouth placement region, and the curved arm rests over the bottom portion of the launching ramp covering at least a portion of the curved guiding track along a complete length of the guiding track.

8. The device of claim 7, wherein the curved arm comprises a cover region and a wall region configuring a stepped region, the cover region forming a lower portion of the stepped region, and wherein when the fence is positioned on the launching ramp the wall region rests upon the curved wall of the bottom portion of the launching ramp, and the cover region covers at least a portion of the curved guiding track of the bottom portion of the launching ramp.

9. The device of claim 1, further comprising at least one of advertising messages, logos, source identifiers, and manufacturer information on an outer surface of at least one of the base, the open top main body, the flange, and the launching ramp.

10. The device of claim 1, further comprising at least one of advertising messages, logos, source identifiers, and manufacturer information on an outer surface of a skirt extending from an outer periphery of the flange.

11. A launching device, comprising:

a ramp comprising a top portion having a downwardly extending placement wall surrounded by a first side wall and a second side wall, configuring a three-walled mouth placement region, and a bottom portion comprising a curved guiding track and a curved wall configuring a stepped region, the curved guiding track forming a lower portion of the stepped region; and a fence comprising a plate portion, and a curved arm extending from a bottom of the plate portion;

wherein the plate portion rests over the top portion of the ramp to configure a four-walled mouth drop region in combination with the three-walled mouth placement region, and the curved arm rests over the bottom portion of the ramp covering at least a portion of the curved guiding track along a complete length of the curved guiding track; and wherein the launching device is mounted outside an outer circumference of a circular body extending downwardly and inwardly from the outer circumference to an aperture, such that circular and spherical objects dropped into the four-walled mouth drop region roll down the curved guiding track and exit tangentially onto an inner surface of the circular body at the outer circumference and further through a downwardly and inwardly spiral path of decreasing radius on the inner surface of the circular body into the aperture.

12. The launching device of claim 11, wherein at least one of the top portion and the bottom portion comprise at least one raised structural feature providing a deflecting surface for directing the circular and spherical objects towards the curved guiding track.

13. The launching device of claim 12, wherein the top portion of the launching ramp comprises a first lug extending from an intermediate portion of the first side wall towards the three-walled mouth placement region.

14. The launching device of claim 12, wherein the bottom portion comprises a second lug extending from a bottom potion of the second side wall towards the curved guiding track.

15. A device for collecting and/or playing with circular and spherical objects, comprising:

a base comprising an open top portion and a closed bottom portion;

an open top main body comprising a rim portion, and a circular portion extending downwardly and inwardly from the rim portion to an aperture concentric with the rim portion and coupling with the open top portion of the base, wherein the open top main body is supported on the base along a common vertical central axis;

a flange extending horizontally and outwardly about the rim portion; and at least one launching ramp mounted on the flange, the launching ramp extending vertically on the flange, the launching ramp comprising a first ramp having a grooved guiding track extending downwardly and outwardly along a curve of decreasing slope from a top to a bottom of the launching ramp, and further extending to a curved stepped region defining a curved guiding track and a curved wall, wherein the curved guiding track forms a lower portion of the curved stepped region, and the curved stepped region tapering inwardly and finally matching with the rim portion of the open top main body, such that, circular and spherical objects placed on the top of the launching ramp roll down the grooved guiding track and further on the curved guiding track and exit tangentially onto an inner surface of the circular portion along the rim portion and further through a downwardly and inwardly spiral path of decreasing radius on the inner surface of the circular portion into the aperture and down into the base.

16. The device of claim 15, wherein the circular and spherical objects comprise at least one of coins, marbles, and ball bearings.

17. The device of claim 15, wherein the launching ramp further comprises a second ramp on an opposite side of the first ramp, the second ramp having a grooved guiding track extending downwardly and outwardly from a top to a bottom of the launching ramp, and further extending to a curved stepped region defining a curved guiding track and a curved wall, wherein the curved guiding track forms a lower portion of the curved stepped region, and the curved stepped region tapering inwardly and finally matching with the rim portion.

18. The device of claim 17, wherein circular and spherical objects placed on top of the launching ramp roll down at least one of the first ramp and the second ramp.

19. The device of claim 17, wherein the device has four launching ramps mounted on the flange, each launching ramp comprising at least one of the first ramp and the second ramp.

20. The device of claim 15, further comprising at least one of advertising messages, logos, source identifiers, and manufacturer information on an outer surface of a skirt extending from an outer periphery of the flange.

* * * * *